United States Patent [19]

Karashima

[11] Patent Number: 4,466,254

[45] Date of Patent: Aug. 21, 1984

[54] REFRIGERATED SHOWCASE

[76] Inventor: Masashi Karashima, 88-5, Nakano, Ebina-shi, Kanagawa-ken, Japan

[21] Appl. No.: 413,437

[22] Filed: Aug. 31, 1982

[30] Foreign Application Priority Data

Jul. 6, 1982 [JP] Japan ..... 57-116216

[51] Int. Cl.[3] ..... A47F 3/04

[52] U.S. Cl. ..... 62/256; 98/36

[58] Field of Search ..... 62/256; 98/36, 40 V, 98/103, 108, 121 R; 126/299 D

[56] References Cited

U.S. PATENT DOCUMENTS

| | | | |
|---|---|---|---|
| 2,182,690 | 12/1939 | Cole | 98/40 V X |
| 2,725,726 | 12/1955 | Swanson | 62/256 X |
| 3,149,476 | 9/1964 | Beckwith | 62/256 |
| 3,157,105 | 11/1964 | Tamm et al. | 98/36 |
| 3,185,181 | 5/1965 | Demyan | 98/40 V X |
| 3,397,631 | 8/1968 | Simons | 62/256 X |
| 3,444,894 | 5/1969 | Norelius | 98/103 X |
| 3,827,254 | 8/1974 | MacMaster et al. | 62/256 |
| 4,288,992 | 9/1981 | Eliason | 62/256 |

FOREIGN PATENT DOCUMENTS

| | | | |
|---|---|---|---|
| 250095 | 11/1962 | Australia . | |
| 1889040 | 12/1964 | Fed. Rep. of Germany . | |
| 2507039 | 7/1976 | Fed. Rep. of Germany | 62/256 |
| 1897942 | 7/1976 | Fed. Rep. of Germany . | |
| 1122604 | 9/1956 | France . | |
| 750267 | 6/1956 | United Kingdom | 62/256 |
| 1172217 | 11/1969 | United Kingdom . | |
| 1268840 | 3/1972 | United Kingdom . | |
| 1445318 | 8/1976 | United Kingdom . | |

*Primary Examiner*—William E. Tapolcai

*Attorney, Agent, or Firm*—Wenderoth, Lind & Ponack

[57] ABSTRACT

A refrigerated showcase of the type that cold air is circulated across its front opening and along its bottom wall, rear wall and top wall, in which a guide plate having a short vertical length is provided hanging from a middle portion, in the depthwise direction of the showcase, of an ejection port of the cold air along the top edge of the front opening, whereby a rectified flow of an air curtain can be elongated down to a suction port along the lower edge of the front opening to prevent air in an ambient atmosphere from invading the showcase.

13 Claims, 19 Drawing Figures

REFRIGERATED SHOWCASE

BACKGROUND OF THE INVENTION

The present invention relates to improvements in an open type refrigerated showcase.

Heretofore, in a refrigerated showcase of the open type, invasion of great amounts of ambient air into the showcase can be a problem, and therefore, a method for minimizing entry of ambient air (b) into the showcase has been employed, in which the lower the temperature in the showcase is, the more layers of air curtains consisting of cold air (a) circulating across a front opening (1) of a refrigerated showcase (A) and along a bottom wall (2), rear wall (3) and top wall (4) thereof are provided, such as a single layer, two layers and three layers, as shown in FIGS. 1, 2 and 3, respectively.

However, in such a prior art structure, in the upper portion of the front opening (1) the ambient air (b) is drawn towards the inside of the showcase so as to collide with shelves (5) resulting in vortexes, the vortexes causing the ambient air (b) to be sucked into the showcase resulting in a lower cooling efficiency.

In order to prevent the above-described invasion of ambient air into the refrigerated showcase, it is necessary to make a layer of cold air extend vertically from an ejection port along the upper edge of the front opening (1) to a suction port along the lower edge thereof by elongating a rectified flow of an air curtain.

However, for the purpose of providing a rectified flow of cold air, it becomes an essential condition to afford an airflow velocity and a directionality to the cold air. If the flow velocity of cold air is increased more than necessary, then the cold air will flow out of the refrigerated showcase, and hence the cooling capability of the showcase will be lowered. Therefore, rectification of a flow at an ejection port becomes the most important necessary condition.

In order to effectively achieve the above-described rectification of a flow of cold air, it is effective to elongate the length of an ejection port as much as possible. However, in view of the structure of a conventional refrigerated showcase, it is impossible to elongate the ejection port to the extent necessary. The present invention has been proposed under the above-mentioned background of the art.

OBJECTS AND SUMMARY OF THE INVENTION

It is therefore one object of the present invention to provide an improved open type refrigerated showcase in which invasion of ambient air into the showcase can be prevented.

Another object of the present invention is to provide an improved open type refrigerated showcase in which the cooling capability thereof can be enhanced by adding a simple member.

According to one feature of the present invention, there is provided a refrigerated showcase of the type such that cold air is circulated across its front opening and along its bottom wall, rear wall and top wall, in which a guide plate having a short vertical length is provided hanging from a middle portion, in the depthwise direction of the showcase, of a cold air ejection port located along the top edge of the front opening.

According to the present invention, since a guide plate is provided hanging from an ejection port along the top edge of the front opening of a refrigerated showcase as described above, a cold air flow ejected from the ejection port is rectified by the vertical guide plate. If the flow rectification of an air curtain consisting of a cold air flow is established in the above-described manner, then flow of ambient air into the refrigerated showcase is prevented, whereby the temperature difference between the upper portion and the lower portion of the showcase is reduced, so that the temperature in the showcase is effectively lowered and the cooling capability of the showcase is abruptly substantially increased. In addition, owing to this great reduction of flow of ambient air into the refrigerated showcase, the amount of frost onto the goods displayed in the showcase is reduced, or, in the case of a refrigerated showcase having a relatively high inner temperature, water drops are not deposit deposited on the goods and the interior of the showcase becomes is dry. As a result, the energy required to defrost such a refrigerated showcase is greatly reduced, and thus, great energy saving can be achieved.

Moreover, according to the present invention, the rectification effect to the cold air flow ejected from the above-mentioned ejection port is produced, the amount of frost on the refrigerator becomes small and hence the efficiency of the refrigerator is improved. Therefore, a substantial energy saving can be achieved.

Also, according to the present invention, since the above-referred to guide plate is provided hanging from a middle portion of the ejection port in the depthwise direction of the showcase, cold air flows along both the inner and outer surfaces of the guide plate and thus the temperatures on the respective surfaces of the guide plate are substantially identical. As a result, neither condensed steam nor larger water drops would be produced thereon, and therefore, in the case of forming the guide plate of a transparent material, the goods displayed in the refrigerated showcase can be clearly observed through the guide plate.

It is to be noted that while the longer the vertical length of the guide plate is, the lower becomes the temperature in the refrigerated showcase, if the guide plate is too long, then the temperature difference between the inner and outer surfaces of the guide plate is increased as the position in question is moved downwards, and an inconvenience would arise such that either the outer surface of the guide plate becomes fogged or water drops are deposited on the outer surface of the guide plate. However, according to the present invention, by forming the guide plate short to such extent that frost is not deposited onto its surfaces and the rectifying effect on the cold air flow is not degraded as described above, not only can the above-described inconveniences be obviated, but also the goods can be directly brought into or out of the interior of the refrigerated showcase through the opening below the guide plate.

Still further, according to one preferred embodiment of the present invention, owing to an additional feature that the guide plate is made of a transparent material, the goods within the refrigerated showcase can be observed through the guide plate, and according to another preferred embodiment of the present invention, owing to a further additional feature that the guide plate is provided with vertical slits extending from its lower edge as aligned at predetermined intervals, the goods can be more easily brought into or out of the interior of the refrigerated showcase by deforming and dividing a large number of rectangular separated pieces formed by the slits along one slit through which a hand is inserted into the showcase.

Although the rectifying effect of the guide plate upon the cold air flow ejected from the ejection port is more substantial as it is formed longer, it can be made sufficiently short as not to inconvenience a customer while shopping, and also it could be made sufficiently short as not interfere with restocking the goods within the refrigerated showcase.

BRIEF DESCRIPTION OF THE DRAWINGS

Other objects, features and advantages of the present invention will become apparent upon consideration of the following specification taken in conjunction with the accompanying drawings, wherein.

DETAILED DESCRIPTION OF THE PREFERRED EMBODIMENTS

Figure 1:
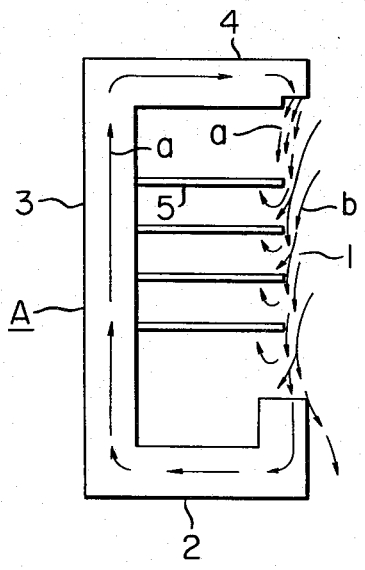
FIG. 1 PRIOR ART
FIGS. 1 to 3 are schematic cross-sectional views showing different types of refrigerated showcases in the prior art.
Figure 2:
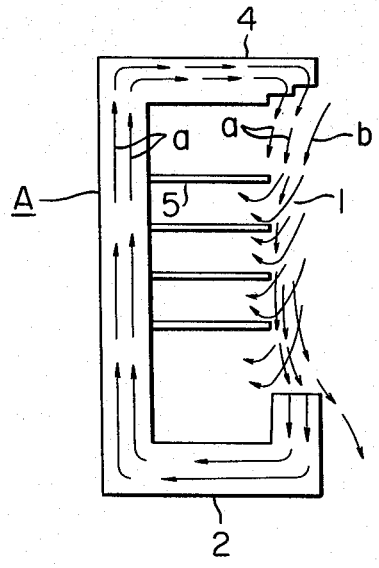
FIG. 2 PRIOR ART
Figure 3:
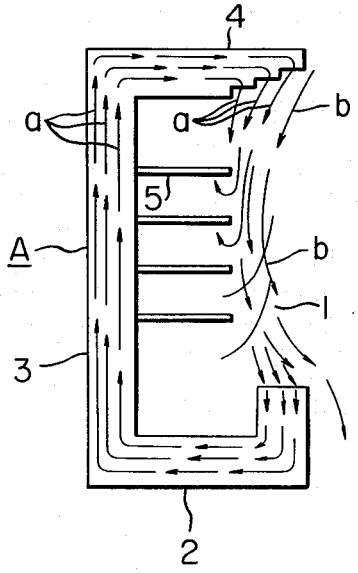
FIG. 3 PRIOR ART
Figure 4:
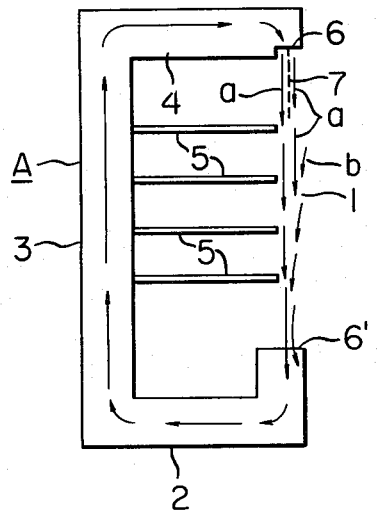
FIGS. 4 to 6 are schematic cross-sectional views showing preferred embodiments of the present invention as applied to different types of refrigerated showcases.
Figure 5:
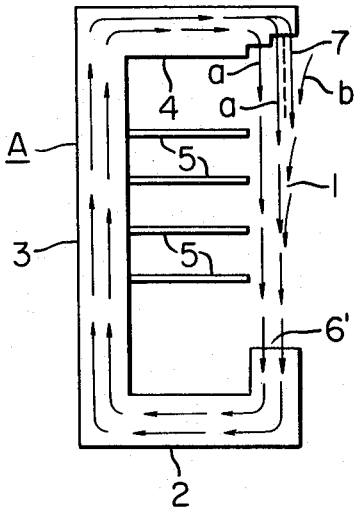
Figure 6:
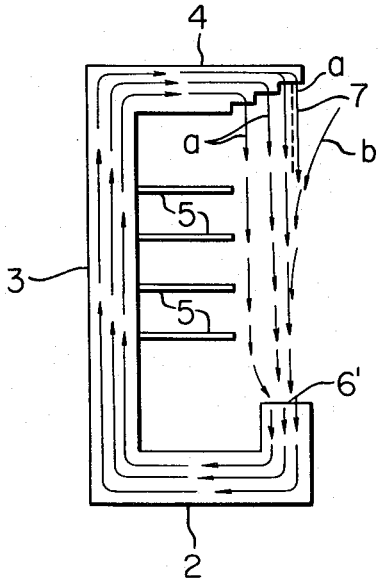
Figure 7:
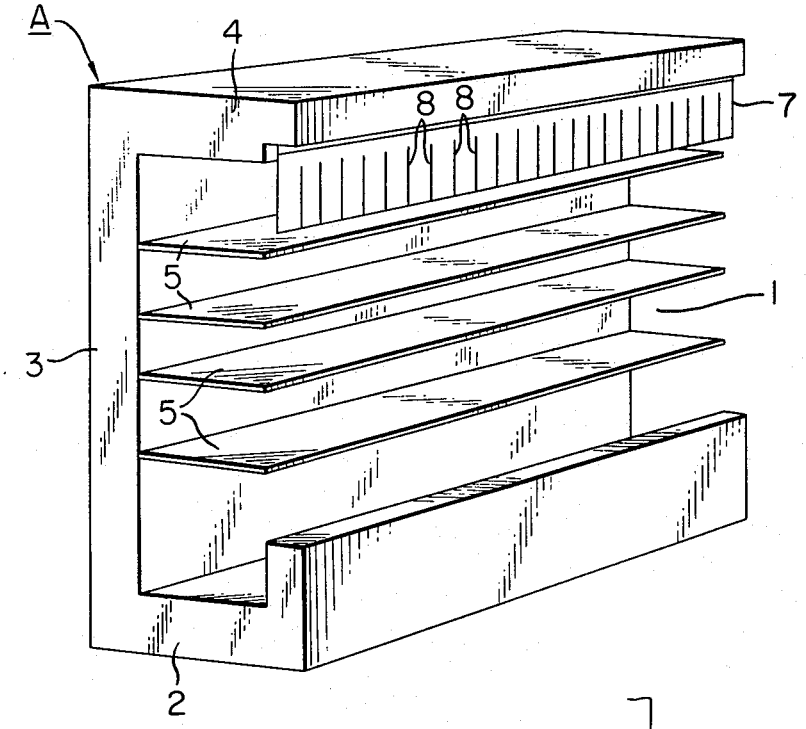
FIG. 7 is a schematic perspective view of one preferred embodiment of the present invention.

Referring now to FIGS. 4 to 7 of the drawings, reference character (A) designates a refrigerated showcase constructed in such a manner that cold air may be circulated across its front opening (1) and along its bottom wall (2), rear wall (3) and top wall (4), and having display shelves (5) for goods disposed therein, in which a guide plate (7) made of a flexible transparent material is vertically mounted at a middle portion, in the depthwise direction of the showcase, of a cold air ejection port (6) along the top edge of the front opening (1). This guide plate (7) is provided with vertical slits (8) extending upward from its lower edge as aligned at predetermined intervals.

Figure 8:
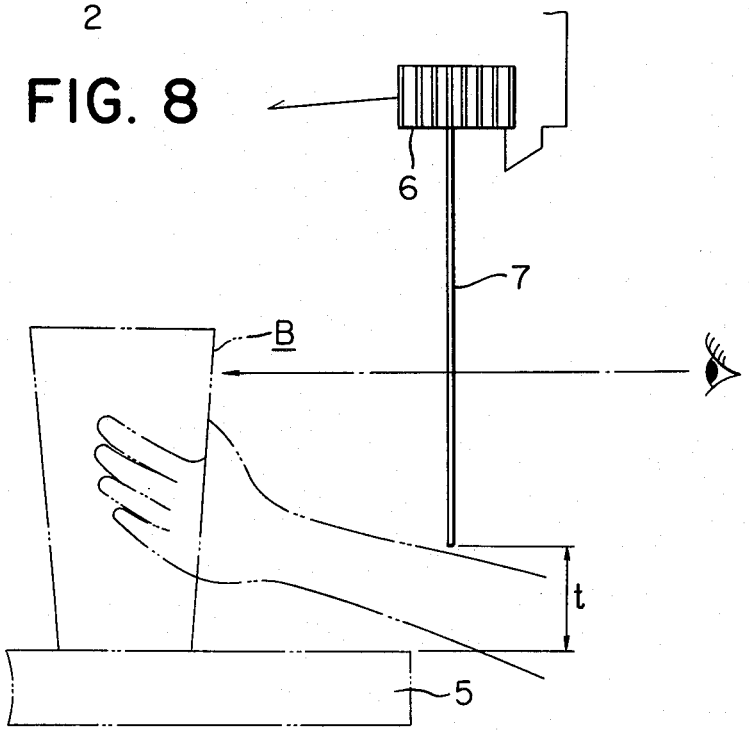
FIG. 8 is a longitudinal cross-sectional view of a portion of the refrigerated showcase including and in the immediate vicinity of the cold air ejection port.

The guide plate (7) is formed to have such length that a sufficient rectification effect can be achieved without dew forming thereon, and a gap of width t is provided between the lower edge of the guide plate (7) and the highest shelf (5), so that one can insert one's hands through the gap of width t into the showcase to insert or remove goods (B) on the shelf (5) (see FIG. 8).

It is to be noted that since the guide plate (7) is made of a transparent material, the goods (B) on the shelf (5) can be observed externally through the guide plate (7), and also, since the slits (8) are formed in the guide plate (7) and thereby a large number of rectangular separated pieces are produced, one can take out or bring in goods by deforming and dividing the separated pieces along one slit through which a hand is inserted.

Figure 9:
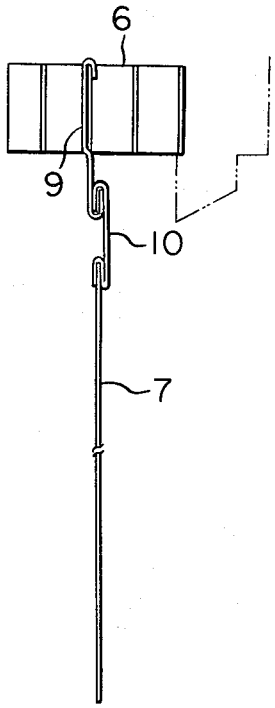
FIG. 9 is a longitudinal cross-sectional view of a guide plate mounting portion.
Figure 10:
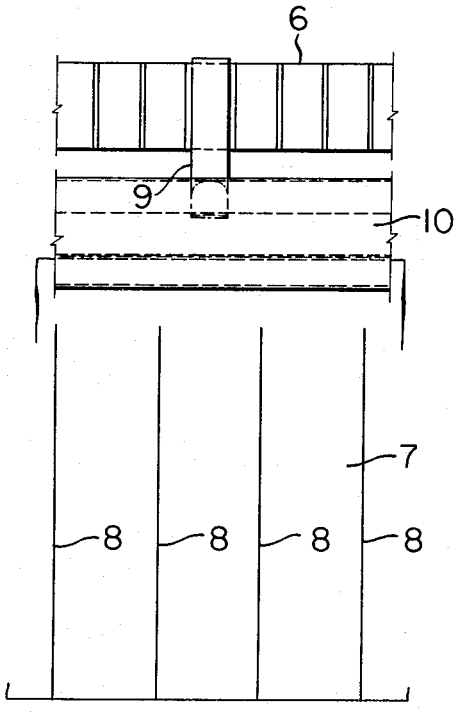
FIG. 10 is a front view of the same portion.

FIGS. 9 and 10 illustrate a mounting device for the guide plate (7), in which an engaging metal piece (10) mounted along the top edge of the guide plate (7) is detachably engaged with a hanging metal piece (9) which is in turn engaged with rectifying lattice plates in the ejection port (6), and thereby the guide plate (7) is detachably hung from a middle portion, in the depthwise direction of the showcase, of the ejection port (6).

Figure 17:
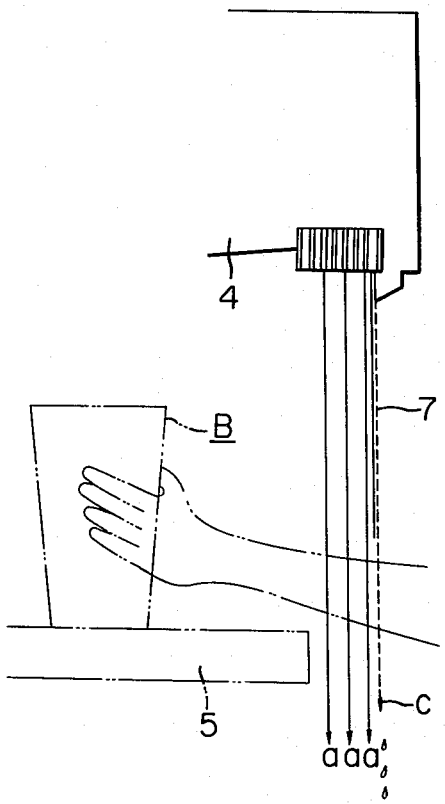
FIGS. 17 and 18 are longitudinal cross section views showing the states of a refrigerated showcase where the mounting position for the guide plate is located at positions different from that specified according to the present invention.

Owing to the fact that the guide plate (7) is disposed in a middle portion, in the depthwise direction of the showcase, of the ejection port (6), both the inner and outer surfaces of the guide plate (7) make contact with cold air (a) ejected from the ejection port (6) and hence no temperature difference will be produced between the inner and outer surfaces. However, if the guide plate (7) is disposed at one end of the ejection port (6) as illustrated in FIG. 17, then only the inner surface of the guide plate (7) makes contact with the cold air (a), whereas the outer surface thereof makes contact with ambient air (b) at a higher temperature, so that dewing would arise on the outer surface of the guide plate (7), and therefore, the disadvantages would arise that the goods (B) become hardly visible, water drops (c) falling from the guide plate will result in damage to the goods placed thereunder and wet the customer's hands when inserted into the showcase.

Figure 18:
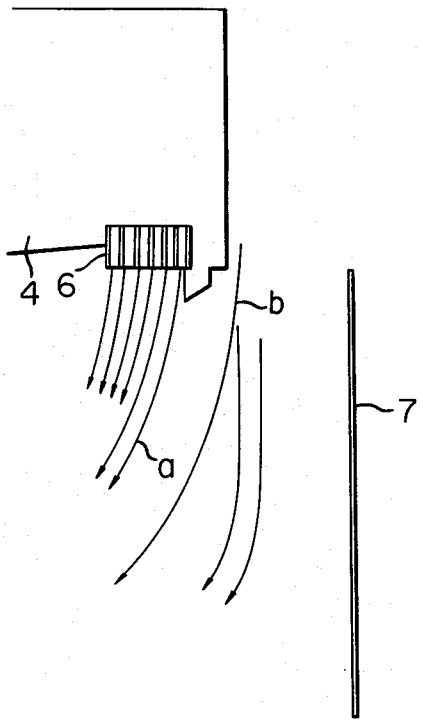

In the event that the guide plate (7) is disposed in front of the ejection port (6) separated therefrom as shown in FIG. 18, the above-mentioned disadvantages would not arise, but ambient air (b) at a higher temperature would flow into the refrigerated showcase, and therefore, the inherent function of the guide plate (7) would not be achieved.

Since the illustrated preferred embodiments are constructed in the above-described manner, the cold air (a) ejected from the ejection port (6) is rectified by the guide plate (7), and thus ambient air (b) is prevented from flowing into the refrigerated showcase, and an air curtain consisting of a flow of the cold air (a) can be formed substantially vertically between the ejection port (6) and a suction port (6') across the front opening (1) of the refrigerated showcase. Therefore, flow of ambient air (b) into the showcase can be prevented, a temperature difference between the upper portion and the lower portion thereof within the refrigerated showcase is reduced thereby effectively lowering the temperature in the showcase and the cooling capability of the showcase is increased. In addition, owing to the great reduction of flow of the ambient air (b) into the refrigerated showcase, the amount of frosting of the goods (B) in the refrigerated showcase is reduced, or in the case of a refrigerated showcase having a relatively high interior temperature, water drops do not adhere to the goods (B), and thus the interior of the showcase remains dry. Thus, energy expended for dehumidifying the refrigerated showcase is greatly reduced, and thereby an energy saving can be achieved.

Figure 13:
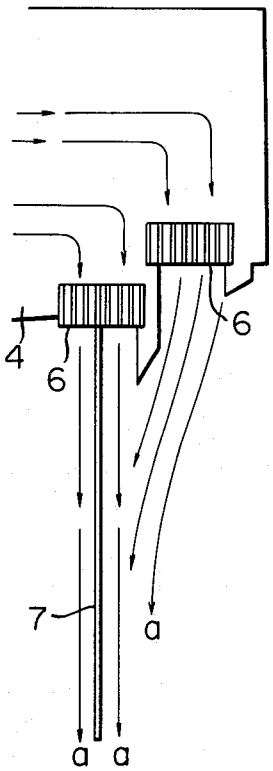
FIGS. 11 through 16 are longitudinal cross-sectional views respectively showing mounting positions for a guide plate relative to a cold air ejection port according to different preferred embodiments of the present invention.
Figure 12:
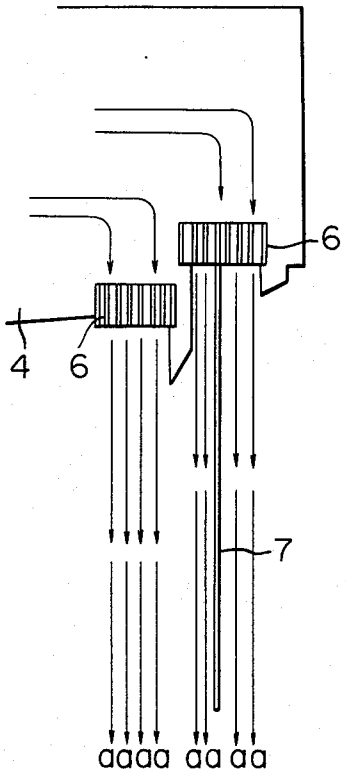
Figure 11:
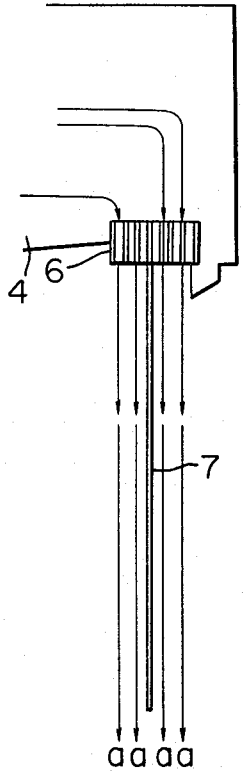
Figure 16:
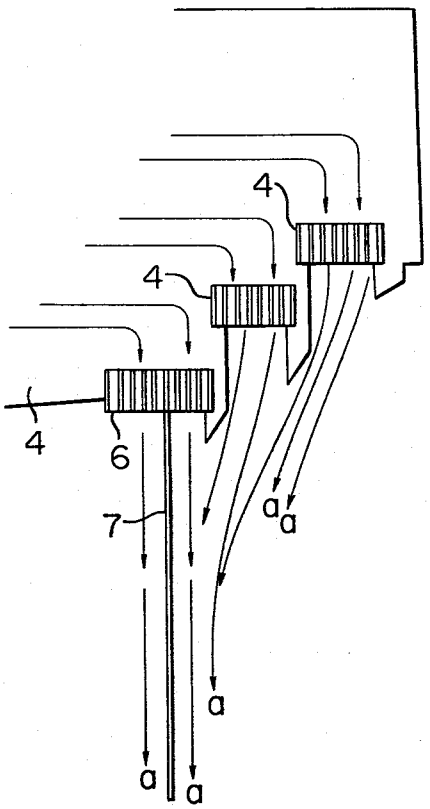
Figure 15:
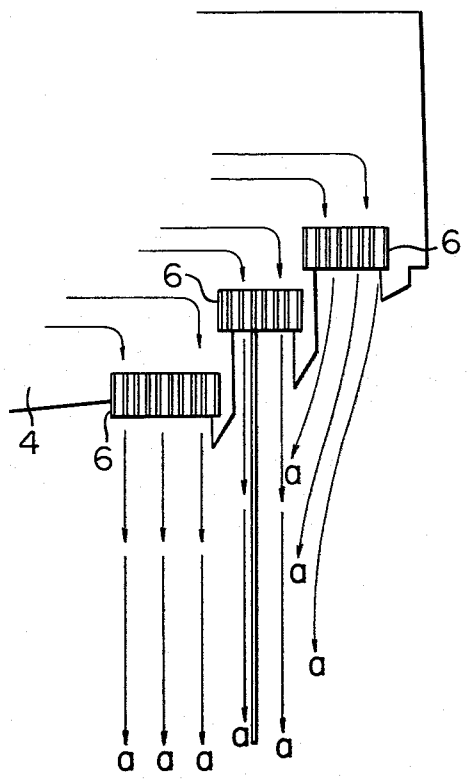
Figure 14:
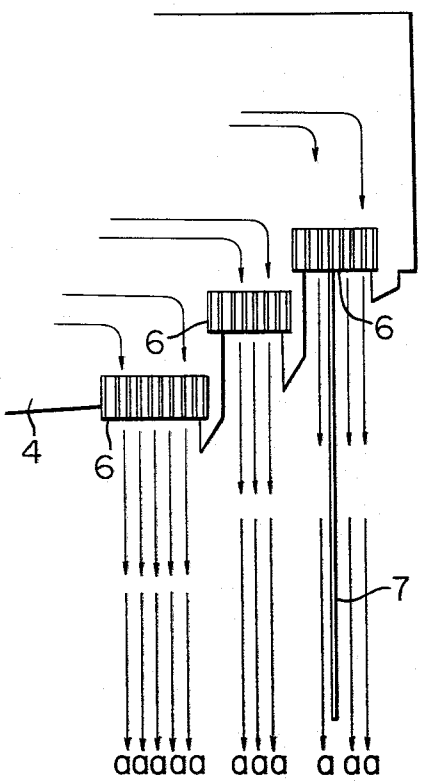

It is to be noted that the above-described guide plate (7) is disposed at a middle portion, in the depthwise direction of the showcase, of the ejection port (6) as shown in FIG. 11 in the case where the air curtain consists of a single layer, but in the case where the air curtain consists of two layers either it is disposed at a middle portion, in the depthwise direction of the showcase, of the outside ejection port (6) as shown in FIG. 12 or it is disposed at a middle portion, in the depthwise direction of the showcase, of the inside ejection port (6) as shown in FIG. 13, and in the case where the air curtain consists of three layers the guide plate (7) is disposed at a middle portion, in the depthwise direction of the showcase, of any one of the outside ejection port (6), the intermediate ejection port (6) and the outside ejection port (6), as shown in FIGS. 14, 15 and 16, respectively.

Figure 19:
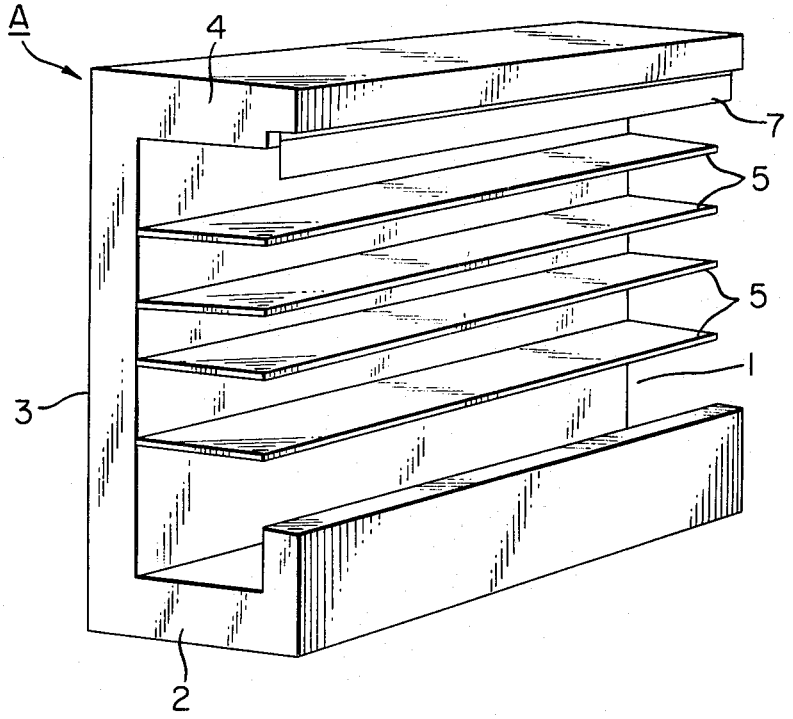
FIG. 19 is a schematic perspective view showing another preferred embodiment of the present invention.

FIG. 19 shows another preferred embodiment of the present invention, in which the guide plate (7) is formed to have a vertical length sufficiently short that customers are unlikely to find the guide plate inconvenient while shopping and also as not to interfere with restocking of the goods in the showcase, and in this modified case the guide plate (7) need not be provided with slits. It is to be noted that so long as the guide plate (7) is formed to have a vertical length that is long enough to rectify the cold air flow of the air curtain to such an extent that vortexes are not generated in the vicinity of the highest one of the shelves (5) within the refrigerated showcase, the guide plate (7) can fully achieve the desired objects.

While the present invention has been described above in connection with preferred embodiments thereof, it is to be understood that the invention is not to be limited to the illustrated embodiments, but various changes in design can be made without departing from the spirit of the present invention.

What is claimed is:

1. A refrigerated showcase comprising;

a frame having a generally vertical rear wall, a top wall and a bottom wall, surrounding a display space, a front opening being defined between said top and bottom walls in front of said rear wall, opening into said display space, said top wall having at least one ejection port opening downwardly therefrom;

means for circulating cold air in a closed air path vertically downwardly out of said at least one ejection port across said front opening and successively through said bottom wall, said rear wall and said top wall to said at least one ejection port, such that the temperature profile of the cold air circulated at one of said at least one ejection port is constant in a horizontal direction generally toward said rear wall; and a guide plate, having a short vertical length relative to the vertical length of said opening, hanging below said top wall across a top portion of said opening from a middle portion of said one of said at least one ejection port so that the air temperature is the same on opposite sides of said guide plate.

2. A refrigerated showcase as in claim 1, wherein said guide plate is a flexible sheet.

3. A refrigerated showcase as in claim 1, wherein said guide plate is transparent.

4. A refrigerated showcase as in claim 3, wherein said guide plate is a flexible sheet having vertical slits at equal intervals therein.

5. A refrigerated showcase as in claim 1, wherein said at least one ejection port includes a first ejection port and a second ejection port;

said upper wall including an outer wall, an inner wall and a partition between said inner and outer walls, each generally parallel said rear wall;

said inner wall and said partition defining therebetween said first ejection port; said partition and said outer wall defining therebetween said second ejection port; said circulation means including means for providing cold air at a first temperature through said first ejection port and means for providing cold air at a second temperature different from the first temperature through said second ejection port, said guide plate hanging between and extending substantially below one of said inner wall and said partition, and said outer wall and said partition, such that the temperature of the air on both sides of said guide plate is equal to one of the first temperature and the second temperature.

6. A refrigerated showcase as in claim 5, wherein said guide plate is a flexible sheet.

7. A refrigerated showcase as in claim 5, wherein said guide plate is transparent.

8. A refrigerated showcase as in claim 7, wherein said guide plate is a flexible sheet having vertical slits at equal intervals therein.

9. A refrigerated showcase as in claim 1, wherein said upper wall includes a first wall and a second wall, each generally parallel said rear wall; said first and second walls defining therebetween said one of said at least one ejection port; said circulation means including means for providing cold air at a constant temperature through said first ejection port; said guide plate hanging and extending substantially below said first and second walls such that the temperature of the air on both sides of said guide plate is equal to the constant temperature.

10. A refrigerated showcase as in claim 9, wherein said guide plate is a flexible sheet.

11. A refrigerated showcase as in claim 9, wherein said guide plate is transparent.

12. A refrigerated showcase as in claim 11, wherein said guide plate is a flexible sheet having vertical slits at equal intervals therein.

13. A refrigerated showcase as in claim 1, further comprising a plurality of shelves vertically disposed in said display case, said guide plate have a length sufficiently long to rectify cold air flow from said one of said at least one ejection port to such an extent that vortexes are not generated in the vicinity of the highest one of said shelves.

* * * * *